US009218949B2

(12) United States Patent
Tanner

(10) Patent No.: US 9,218,949 B2
(45) Date of Patent: Dec. 22, 2015

(54) STRATEGIC DYNAMIC RANGE CONTROL FOR TIME-OF-FLIGHT MASS SPECTROMETRY

(71) Applicant: FLUIDIGM CANADA INC., Markham (CA)

(72) Inventor: Scott D. Tanner, Aurora (CA)

(73) Assignee: Fluidigm Canada, Inc., Markham (CA)

( * ) Notice: Subject to any disclaimer, the term of this patent is extended or adjusted under 35 U.S.C. 154(b) by 0 days.

(21) Appl. No.: 13/909,721

(22) Filed: Jun. 4, 2013

(65) Prior Publication Data

US 2014/0353484 A1 Dec. 4, 2014

(51) Int. Cl.
*H01J 49/40* (2006.01)
*H01J 49/02* (2006.01)

(52) U.S. Cl.
CPC ..... *H01J 49/40* (2013.01); *H01J 49/025* (2013.01)

(58) Field of Classification Search
USPC ..... 250/282, 281, 283
See application file for complete search history.

(56) References Cited

U.S. PATENT DOCUMENTS

| | | | | |
|---|---|---|---|---|
| 4,490,806 | A | 12/1984 | Enke et al. | |
| 4,499,052 | A | 2/1985 | Fulwyler | |
| 4,583,183 | A | 4/1986 | Winiecki et al. | |
| 5,367,162 | A | 11/1994 | Holland et al. | |
| 6,140,638 | A | 10/2000 | Tanner et al. | |
| 6,242,735 | B1 | 6/2001 | Li et al. | |
| 6,836,742 | B2 | 12/2004 | Brekenfeld | |
| 7,135,296 | B2 | 11/2006 | Baranov et al. | |
| 7,198,900 | B2 | 4/2007 | Woudenberg et al. | |
| 7,321,847 | B1 * | 1/2008 | Welkie et al. | 702/199 |
| 7,375,569 | B2 | 5/2008 | Hall et al. | |
| 7,479,630 | B2 | 1/2009 | Bandura et al. | |
| 7,700,295 | B2 | 4/2010 | Baranov et al. | |
| 7,767,407 | B2 | 8/2010 | Baranov et al. | |
| 7,928,361 | B1 * | 4/2011 | Whitehouse et al. | 250/281 |
| 8,101,368 | B2 | 1/2012 | Ornatsky et al. | |
| 8,283,624 | B2 | 10/2012 | Antonov et al. | |
| 8,283,628 | B2 * | 10/2012 | Hoyes et al. | 250/282 |
| 8,481,925 | B2 | 7/2013 | Antonov et al. | |
| 2002/0003210 | A1 | 1/2002 | Marcus | |

(Continued)

FOREIGN PATENT DOCUMENTS

| | | | |
|---|---|---|---|
| WO | 98/33203 | A1 | 7/1998 |
| WO | 2005/093784 | A1 | 10/2005 |

(Continued)

OTHER PUBLICATIONS

Bandura et al., "Effect of Collisional Damping and Reactions in a Dynamic Reaction Cell on the Precision of Isotope Ratio Measurements," The Royal Society of Chemistry 2000, published on the web Jul. 26, 2000, pp. 921-928, Canada.

(Continued)

*Primary Examiner* — Phillip A Johnston
*Assistant Examiner* — Hsien Tsai
(74) *Attorney, Agent, or Firm* — Kilpatrick Townsend & Stockton LLP

(57) ABSTRACT

A mass spectrometer of the type useful in mass cytometry includes an ion detector. A digitizing system for converting analog signals from the ion detector includes two analog-to-digital converters. The analog-to-digital converters are configured to provide an increased dynamic range for a targeted period while limiting the amount of data generated.

21 Claims, 3 Drawing Sheets

(56) References Cited

U.S. PATENT DOCUMENTS

| | | | | |
|---|---|---|---|---|
| 2002/0028434 | A1 | 3/2002 | Goix et al. | |
| 2003/0111597 | A1 | 6/2003 | Gonin et al. | |
| 2004/0126277 | A1 | 7/2004 | Yamamoto | |
| 2005/0073683 | A1 | 4/2005 | Gard et al. | |
| 2006/0016977 | A1 | 1/2006 | Kawato | |
| 2006/0289747 | A1 | 12/2006 | Schultz et al. | |
| 2007/0046934 | A1 | 3/2007 | Roy | |
| 2007/0063139 | A1 | 3/2007 | Hall et al. | |
| 2007/0190560 | A1 | 8/2007 | Ornatsky | |
| 2007/0190588 | A1 | 8/2007 | Ornatsky | |
| 2008/0003616 | A1 | 1/2008 | Winnik et al. | |
| 2009/0001264 | A1 | 1/2009 | Yamamoto | |
| 2009/0050801 | A1 | 2/2009 | Fedorov | |
| 2011/0284736 | A1* | 11/2011 | Willis et al. | 250/282 |
| 2012/0126114 | A1 | 5/2012 | Bandura et al. | |
| 2012/0164632 | A1 | 6/2012 | Ornatsky et al. | |
| 2013/0181126 | A1 | 7/2013 | Jong | |

FOREIGN PATENT DOCUMENTS

| | | | |
|---|---|---|---|
| WO | 2007093049 | A1 | 8/2007 |
| WO | 2007/140571 | A1 | 12/2007 |
| WO | 2008/080224 | A1 | 7/2008 |

OTHER PUBLICATIONS

Baranov et al., "A Sensitive and Quantitative Element-Tagged Immunoassay with ICPMS Detection," Analytical Chemistry, Apr. 1, 2002, vol. 74, No. 7, pp. 1629-1636.

Baranov et al., "ICP-MS as an Elemental Detector in Immunoassays, Speciation Without Chromatography," 2001, European Winter Conference on Plasma Spectrochemistry, Hafjell, Norway, Winter 2001 Book of Abstracts, p. 85.

Baranov et al., "The Potential for Element Analysis in Biotechnology," Journal of Analytical Atomic Spectrometry, 2002, 17, pp. 1148-1152.

Beavis, "Increasing the Dynamic Range of a Transient Recorder by Using Two Analog-to-Digital Converters," Journal of the American Society for Mass Spectrometry, 1996, vol. 7, pp. 107-113.

Bettmer et al., "Elemental Tagging in Inorganic Mass Spectrometric Bioanalysis," Analytical and Bioanalytical Chemistry, 2006, 386, pp. 7-11, published on the web Jul. 20, 2006, Germany.

Gikunju et al., "Detection and Identification of Bacteria Using Direct Injection Inductively Coupled Plasma Mass Spectroscopy," Talanta, 2004, 62, pp. 741-744.

Gonzalez et al., "Metal Particles Produced by Laser Ablation for ICP-MS Measurements," Talanta, 2007, 73, pp. 567-576.

Hobbs et al., "Inductively Coupled Plasma Mass Spectrometry Signal Fluctuations Due to Individual Aerosol Droplets and Vaporizing Particles," Analytical Chemistry,1992, 64, pp. 274-283.

Houk et al., "Inductively Coupled Argon Plasma as an Ion Source for Mass Spectrometric Determination of Trace Elements," Analytical Chemistry, 1980, 52, pp. 2283-2289.

Jakubowski et al., "Metallobiomolecules. The Basis of Life, the Challenge of Atomic Spectroscopy," The Royal Society of Chemistry, published on the web Dec. 19, 2003, 4 pgs. Germany.

Jorabchi et al., "In Situ Visualization and Characterization of Aerosol Droplets in an Inductively Coupled Plasma," Analytical Chemistry 2005, vol. 77, No. 5, pp. 1253-1260.

Lee et al., "Direct Mass Spectrometric Analysis of Intact Proteins of the Yeast Large Ribosomal Subunit Using Capillary LC/FTICR," Proceedings of the National Academy of Sciences, Apr. 30, 2002, vol. 99, No. 9, pp. 5942-5947.

Li et al., "Behavior of Bacteria in the Inductively Coupled Plasma: Atomization and Production of Atomic Ions for Mass Spectrometry," Analytical Chemistry 2005, vol. 77, No. 5, pp. 1407-1413.

Liu et al., "Method for Quantitative Proteomics Research by Using Metal Element Chelated Tags Coupled with Mass Spectrometry," Analytical Chernistry, 2006, vol. 78, No. 18, pp. 6614-6621.

Lou et al., "Polymer-Based Elemental Tags for Sensitive Bioassays," Angew. Chem. Int. Ed., 2007, 46, pp. 6111-6114.

Merkoci et al., "Toward an ICPMS-Linked DNA Assay Based on Gold Nanoparticles Immunoconnected Through Peptide Sequences," Analytical Chemistry, vol. 77, No. 19, Oct. 1, 2005, pp. 6500-6503, Spain.

Nomizu et al., "Determination of Zinc in Individual Airborne Particles by Inductively Coupled Plasma Mass Spectrometry with Digital Signal Processing," The Royal Society of Chemistry 2002, published on the web May 9, 2002, Japan, pp. 592-595.

Nomizu et al., "Determination of Calcum Content in Individual Biological Cells by Inductively Coupled Plasma Atomic Emission Spectrometry," Analytical Chemistry, Oct. 1, 1994, vol. 66, No. 19, pp. 3000-3004.

Olesik et al., "Incompletely Desolvated Droplets in Argon Inductively Coupled Plasmas: Their Number, Original Size and Effect on Emission Intensities," Spectrochimica Acta, 1991, vol. 46B, No. 6/7, pp. 851-868.

Olesik et al., "Signal Fluctuations Due to Individual Droplets in Inductively Coupled Plasma Atomic Emission Spectrometry," Analytical Chemistry, 1989, 61, pp. 2002-2008.

Ornatsky et al., "Development of Analytical Methods for Multiplex Bio-Assay with Inductively Coupled Plasma Mass Spectrometry," Journal of Analytical Atomic Spectrometry, 2008, 23, pp. 463-469, published on the web Jan. 4, 2008, Canada.

Ornatsky et al., "Messenger RNA Detection in Leukemia Cell Lines by Novel Metal-Tagged in situ Hybridization Using Inductively Coupled Plasma Mass Spectrometry," Translational Oncogenomics, 2006, pp. 1-9, Canada.

Ornatsky et al., "Multiple Cellular Antigen Detection by ICP-MS," Journal of Immunological Methods 308 (2006), available on the web Nov. 21, 2005, pp. 68-76, Canada.

Ornatsky et al., "Study of Cell Antigens and Intracellular DNA by Identification of Element-Containing Labels and Metallointercalators Using Inductively Coupled Plasma Mass Spectrometry," Analytical Chemistry, Apr. 1, 2008, vol. 80, No. 7, pp. 2539-2547, Germany.

PDA1000 1 GHz Waveform Digitizer Product Information Sheet, Signatect Inc.,359 San Miguel Drive, Suite 300, Newport Beach, CA 92660, U.S.A., May 16, 2005, 6 pages.

Piseri et al., "Time-of-Flight Analysis of Neutral Cluster Beams Through Detection of Charged Particles Produced by Cluster Impact on a Channeltron, Review of Scientific Instruments," vol. 69, No. 4 Apr. 1998, pp. 1647-1649.

Quinn et al., "Simultaneous Determination of Proteins Using an Element-Tagged Immunoassay Coupled with ICP-MS Detection," Journal of Analytical Atomic Spectrometry, 2002, 17, pp. 892-896.

Razumienko, "Element-Tagged Immunoassays with ICP-MS Detection: Evaluation and Comparison to Conventional Immunoassays," Journal of Immunological Methods 336, 2008, pp. 56-63, Canada.

Reents Jr. et al., "Single Particle Characterization by Time-of-Flight Mass Spectrometry," Aerosol Science and Technology, 1995, vol. 23, No. 3, pp. 263-270.

Scheffer et al., "ICP-MS as a New Tool for the Determination of Gold Nanoparticles in Bioanalytical Applications," Analytical and Bioanalytical Chemistry, 2008, 390, pp. 249-252, published on the web Sep. 15, 2007, Germany.

Shigematsu et al., "Determination of Manganese in Natural Waters by Atomic Absorption Spectrometry with a Carbon Tube Atomizer," 1975, Analytica Chimica Acta 76, pp. 329-336.

Tanner et al., "Flow Cytometer with Mass Spectrometer Detection for Massively Multiplexed Single-Cell Biomarker Assay," Pure and Applied Chemistry, 2008, vol. 80, No. 12, pp. 2627-2641.

(56) References Cited

OTHER PUBLICATIONS

Tanner, et al., "Multiplex Bio-Assay with Inductively Coupled Plasma Mass Spectrometry: Towards a Massively Multivariate Single-Cell Technology," Spectrochimica Acta Part B 62, 2007, published on the web Feb. 6, 2007, pp. 188-195, Russia.
Tanner, "Space charge in ICP-MS: Calculation and implications," Spectrochimica Acta, 1992, vol. 47B, No. 6, pp. 809-823.
Thomas, "A Beginner's Guide to ICP-MS. Part VIII—Mass Analyzers: Time-of-Flight Technology," Spectroscopy Tutorial, Spectroscopy, Jan. 2002, vol. 17, No. 1, pp. 36-41.
Todoli et al., "New Torch Design with an In-Built Chamber for Liquid Sample Analysis by ICP-AES," Journal of Analytical Atomic Spectrometry, 2002, 17, pp. 345-351.
Xin Lu et al., "Recent Developments in Single-Cell Analysis," Analytica Chimica Acta 510, 2004, pp. 127-138.

* cited by examiner

STRATEGIC DYNAMIC RANGE CONTROL FOR TIME-OF-FLIGHT MASS SPECTROMETRY

FIELD

The invention relates generally to systems and methods for acquiring and digitizing data from an analog detector, and more particularly to systems and methods for acquiring and digitizing data from an ion detector of a time-of-flight (TOF) mass analyzer.

BACKGROUND

In a time-of-flight (TOF) mass analyzer, as a transient pulse of ions arrives at a detector, it causes the detector to generate an analog output signal whose amplitude is nominally proportional to the number of ions of a particular group. The transit time, measured from the instance when an ion is pushed into a TOF chamber under the influence of an electrostatic push pulse to the time at which the analog ion detector signal is produced, represents the ions' mass-to-charge (m/z) value. A time-of-flight spectrum is produced by summing up the signals from many transient pulses of ions with a data acquisition system capable of handling large amounts of data created within very short time periods.

In the data acquisition system, the analog signal from the ion detector can be digitized with an analog-to-digital converter (ADC) and the digital data is recoded as a function of the transit time to correspond with the m/z values of the detected ions. A waveform capture board with a high sampling rate and on-board memory can be used to perform the analog-to-digital conversion in real time over the range of transit times (mass range) of interest. Typical commercially available waveform digitizers suitable for TOF applications, for example, have a resolution of 8-bits (to give 255 points of analog to digital conversion) and a sampling rate of 1 GHz (providing 1 nanosecond of transit time resolution and the capability of generating 1 GB of data per second).

Generally, an 8-bit, 1-GB/s data digitizer system can provide a response of about four orders of magnitude of resolution. However, in some applications, a wider dynamic range or increased resolution beyond the capability of the current 8-bit digitizers may be desired. For example, when an analysis contains a waveform with a meaningful analog signal having amplitudes less than the lower limit set by the 8-bit voltage comparator, the signal can be overlooked as low level noise. Similarly, an analog signal intensity that is above the 8-bit maximum voltage level may be inaccurately recorded as being equal to the threshold limit and thus affecting quantitation measurements. If the dynamic range of the 8-bit ADC is extended to accept higher analog signals, the resolution will suffer because of the increased coarseness of each conversion step. Potentially, a digitizer with higher resolution capabilities beyond one byte could alleviate this problem but higher resolving ADC's are generally limited to sampling rates of less than 1 GHz operation and/or may be a commercially unfeasible option because of their higher cost and power requirements.

In some cases, one can increase the dynamic range by using two digitizers (analog-to-digital converters or ADC's) simultaneously where each digitizer is set to a different input voltage range. However, using two ADCs simultaneously can generate twice the amount of data since both digitizer produce independently parallel bytes for each digitized point. The volume of data for each analysis can be potentially large and can overwhelm the data processing system. For instance, a push pulse frequency of 80 kHz can be provided by a pulse generator so that 80,000 new spectra can be generated per second. The pulse frequency is chosen according to the length of the flight path so that fast traveling ions from one transient pulse do not overlap with slower ions from the previous transient pulse. While the analog ion detector produces an analog signal as a function of time for each spectrum, the 1 GHz digitizer can divide each analog signal into 1 ns intervals (points) over the total time period of each signal. Typically, the number of intervals over the mass range of interest will determine how well adjacent masses can be distinguished (mass resolution), and the mass range can be defined by the lower and upper transit times calculated according to the flight path of the time-of-flight instrument. In some cases, the difference between the lower and upper transit times can be about 5000 ns and, with a 1 ns digitizing rate, the number of intervals can be in the order of 5000 points. Thus, if two 8-bit digitizers are used simultaneously to collect 5000 interval points for each of the 80,000 spectra per second, the accumulated data for a 1 second spectrum is $6.4\times10^9$ bits, or 0.1 GB/s. Since an average acquisition time is about 300 seconds in duration, a single data file created by two 8-bit ADC can be 30 GB or larger. Although data compression can be used to reduce the file size, the raw data can nevertheless be a challenge for the processor's capabilities.

SUMMARY

One aspect of the present teaching is a mass spectrometer. The mass spectrometer has ion optics for receiving ionized sample material from an ion source and conveying at least some ions from the ionized sample material through the ion optics. A time-of-flight mass analyzer is coupled to the ion optics for receiving at least some of the ions conveyed by the ion optics. The mass analyzer includes a time-of-flight chamber, an ion pulsing system for periodically generating an electrical field to direct groups of the received ions into the time-of-flight chamber, and an ion detector arranged to receive ions that have traveled through the time-of-flight chamber for generating a signal indicative of the number of ions arriving at the ion detector as a function of time. The signal includes information about mass spectra of the groups of ions produced by the pulsing system. The mass spectrometer has a digitizing system for receiving and digitizing the signal from the ion detector and for providing extended dynamic range data during a target period. The digitizing system includes first and second analog-to-digital converters. The first analog-to-digital converter is configured to receive and digitize the signal from the ion detector during a first time window coinciding with a first portion of each mass spectrum. The second analog-to-digital converter is configured to receive and digitize the signal from the ion detector during a second time window coinciding with a second portion of each mass spectrum. The first and second time windows are offset time-wise relative to one another and overlap one another during the target period.

Another aspect of applicant's teaching is a mass spectrometer. The mass spectrometer has ion optics for receiving ionized sample material from an ion source and conveying at least some of the ions from the ion source through the ion optics. The mass spectrometer includes a time-of-flight mass analyzer coupled to the ion optics for receiving at least some of the ions conveyed by the ion optics. The mass analyzer includes a time-of-flight chamber, an ion pulsing system for periodically generating an electrical field to direct groups of the received ions into the time-of-flight chamber, and an ion detector arranged to receive ions that have traveled through the time-of-flight chamber for generating a signal indicative of the number of ions arriving at the ion detector as a function of time. The signal includes information about mass spectra of the groups of ions produced by the pulsing system. The mass spectrometer has a digitizing system adapted to receive and digitize the signal from the ion detector. The digitizing system is adapted to sample and digitize the signal in a first dynamic range during a first time period, sample and digitize the signal in a second dynamic range larger than the first dynamic range at a second time period for providing extended dynamic range data during the second time period, and then sample and digitize data from a third dynamic range different from the second dynamic range at a third time period. Each of the first, second, and third time periods corresponds to expected times of arrival at the ion detector of ions within each mass spectrum.

Still another feature of applicant's teaching is a method of operating a time-of-flight mass spectrometer. The method includes conveying ionized sample material from an ion source to a time-of-flight mass analyzer that has a time-of-flight chamber, an ion detector, and an ion pulsing system. An electrical field is periodically generated using the ion pulsing system to direct a plurality of groups of the ions received by the mass analyzer through the time-of-flight chamber to the ion detector. A signal indicative of the number of ions arriving at the ion detector as a function of time is output from the ion detector. The signal includes information about mass spectra of the groups of ions produced by the pulsing system. The signal from the ion detector is sampled and digitized in a first dynamic range during a first time period, sampled and digitized in a second dynamic range larger than the first dynamic range at a second time period for providing extended dynamic range data during the second time period, and then sampled and digitized in a third dynamic range different from the second range at a third time period. Each of the first, second, and third time periods corresponds to expected times of arrival at the ion detector of ions within each mass spectrum.

Another aspect of the present teaching is a digitizing system for receiving and digitizing an analog signal. The digitizing system has first and second analog-to-digital converters. The first analog-to-digital converter is configured to receive and digitize the signal from the ion detector during a first time window. The second analog-to-digital converter is configured to receive and digitize the signal from the ion detector during a second time window. The first and second time windows are offset time-wise relative to one another and overlap one another during a target period for providing extended dynamic range data during the target period.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
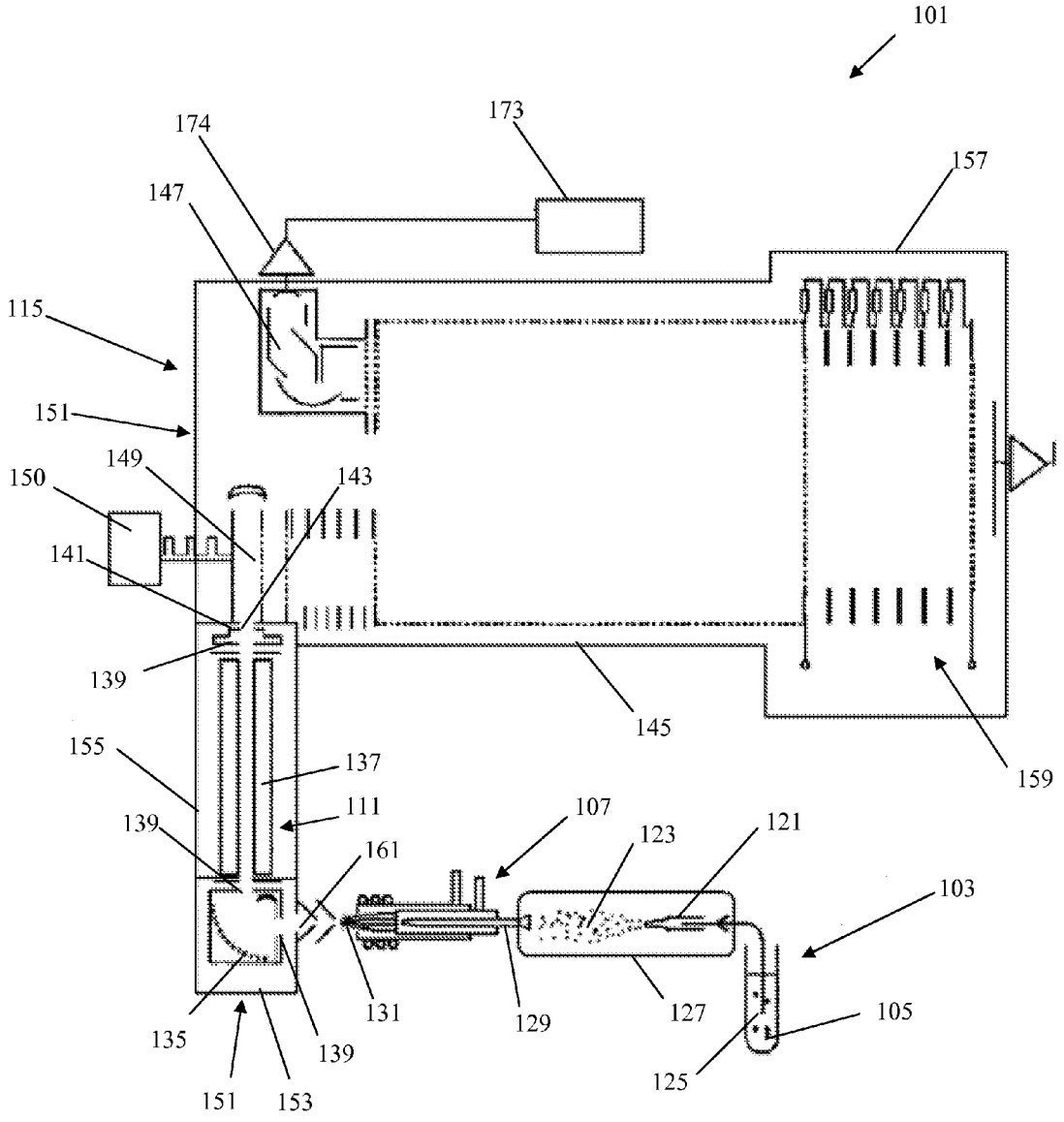
FIG. 1 is a diagrammatic view of a mass spectrometer.

Referring now to the drawings, first to FIG. 1, one embodiment of a mass spectrometer is generally designated 101. In general, the mass spectrometer 101 has a sample introduction system 103 for introducing sample material 105 into an ion source 107. The ion source 107 ionizes material to produce ions. Some of the sample material 105 is ionized at the ion source 107 to produce ions from the sample material. Ion optics 111 guide at least some of the ions from the ion source 107 to a mass analyzer 115 that is able to determine the mass/charge (m/z) ratio of at least some of the ions to obtain information about the sample material 105.

Various sample introduction systems for mass spectrometers are known to those skilled in the art and any of them can be used. In the illustrated embodiment, for example, the sample introduction system 103 is illustrated as including a nebulizer 121 that generates droplets 123 from liquid sample 125. The droplets 123 are conveyed through a spray chamber 127 and conduit 129 along with argon on another suitable carrier gas to the ion source 107. One suitable example of a sample introduction system is described in more detail in co-owned U.S. patent application Ser. No. 13/661,686, entitled Sample Transferring Apparatus for Mass Cytometry, the entire contents of which are hereby incorporated by reference. Other suitable sample introduction systems include ablation systems that use a laser to ablate a small piece of sample material and form a plume of vapor that is carried to the ion source by a carrier gas. For example, Matrix Assisted Laser Desorption and Ionization (MALDI) systems and similar laser ablation systems are also suitable sample introduction systems.

The ion source 107 in the illustrated embodiment uses an inductively coupled plasma (ICP) device 131 to ionize the sample material 105. The inductively coupled plasma device 131 vaporizes, atomizes, and ionizes at least some of the sample material 105 to produce elemental ions from the sample material 105. The inductively coupled plasma device 131 can also atomize and ionize the carrier gas. Although the ion source 107 in the illustrated embodiment is an ICP device 131, it is understood other ion sources can be used instead of an ICP device without departing from the scope of the applicant's teaching. For example, other atmospheric ion sources can be used. Likewise, ions sources that operate at pressures lower than atmospheric pressure can also be used within the scope of the applicant's teaching.

The ion optics 111 are positioned to receive at least some of the ions from the ion source and guide a beam of ions to the mass analyzer 115. Any ion optics capable of guiding at least some of the ions from the ion source 107 to the mass analyzer 115 can be used within the broad scope of the applicant's teaching. Those skilled in the art will be familiar with various devices that can be included in a suitable set of ion optics. These include, without limitation, multipole ion guides (e.g., quadrupoles), einzel and other electrostatic lenses, electrostatic deflectors, and other devices. The ion optics can include one or more devices that modify the ions, such as a collision cell that operates to reduce larger non-atomized ions into smaller ion fragments. The ion optics 111 do not necessarily convey all of the ions from the ion source 107 to the mass analyzer 115. It is understood by those skilled in the art that mass spectrometers can operate with ion optics that have a relatively low ion transmission efficiency. Moreover, the ion optics can optionally include one or more devices that eject selected ions from the ion beam as it is conveyed to the mass analyzer. For example, a multipole ion guide (e.g., quadrupole) can be operated in a manner that allows ions having certain characteristics to pass through the ion optics while other ions are ejected from the ion beam. The selected ions can change over time, as may be desired to analyze a first type of ions during a first period followed by other types of ions in a second period.

In the illustrated embodiment, the ion optics 111 include an electrostatic deflector 135 that turns at least ions of interest in the ion beam at an angle (e.g., about 90 degrees) so the beam containing the ions of interest is directed into a quadrupole ion guide 137 that conveys the ions toward the mass analyzer. The ion optics 111 include a plurality of different ion lenses 139 to collimate, focus, and defocus the ions as may be desired to facilitate guidance of ions of interest from the ion source to the mass analyzer 115.

The mass analyzer 115 is positioned to receive ions from the ion optics 111. For instance, the mass analyzer 115 is suitably coupled to an outlet 141 at the end of the ion optics so an inlet 143 of the mass analyzer 115, and is aligned with the outlet of the ion optics 111 so the ion beam conveyed by the ion optics is conveyed into the mass analyzer. Those skilled in the art will be aware of many different types of mass analyzers. Any mass analyzer that is operable to determine the mass/charge ratios of ions received from the ion optics can be used within the broad scope of the applicant's teaching. In the illustrated embodiment, the mass spectrometer has a time-of-flight (TOF) mass analyzer 115. The time-of-flight mass analyzer suitably includes a time-of-flight chamber 145, a ion detector 147, and a pulsing system 149 supplied by pulsing electronic 150 adapted to periodically generate an electric field to accelerate a series of ion groups so the ions travel through the time-of-flight chamber to the ion detector. The mass spectrometer in the illustrated embodiment has an ion mirror 159 at one end of the TOF chamber 145 so the ions travel from the pulsing region 149 to the ion mirror 159 and then from the ion mirror back to the detector 147. However, this is not required within the broad scope of the applicant's teaching. As is known to those skilled in the art, the time of arrival of each ion in a particular group is a function of the mass/charge ratio of the ion. Each group of ions that is ejected by the electrostatic impulse associated with a single pulse at the pulsing region 149 forms a single mass spectra, which can be expressed as the number of ions arriving at the detector as a function of time.

The ion optics 111 are substantially enclosed in a vacuum chamber 151. As illustrated in FIG. 1, for example, the ion optics 111 are substantially enclosed within one or more stages of a multi-stage differentially-pumped vacuum chamber 151. In the illustrated embodiment the vacuum chamber 151 has three stages 153, 155, 157, but the number of stages can vary within the scope of the applicant's teaching. There is an inlet 161 into the vacuum chamber 151 positioned to receive ions from the ion source 107. In the illustrated embodiment, the inlet 161 is at a vacuum interface adjacent the ICP device 131. Some of the ion optics 111 are adjacent the vacuum interface in the first stage 153 of the vacuum chamber 151. For example, various electrostatic lenses 139 and the electrostatic deflector 135 are positioned in the first stage 153 and guide the ion beam into the second stage 155 of the vacuum chamber 151. Additional components of the ion optics 111, which in the illustrated embodiment include the quadrupole ion 137 guide and various ion lenses 139, are positioned in the second stage 155 of the vacuum chamber 151 and guide the ion beam to the mass analyzer 115. In the illustrated embodiment, the interior space of the third stage 157 forms the time-of-flight chamber for the mass analyzer 115. The ion optics can be in multiple different vacuum stages, as in the illustrated embodiment in which the ion optics 111 are substantially enclosed within the first and second stages 153, 155 of the vacuum chamber 151, or all the ion optics can be substantially enclosed in a single vacuum stage.

The ion detector 147 outputs an analog signal (e.g., a voltage) when impacted by ions from the sample. The amplitude of the analog signal is proportionate to the number of ions impacting the ion detector 147 at a given time. The time from activation of the pulsing system 149 to ion strike on the ion detector corresponds to the mass to charge ratio of the particular ions. Accordingly, by detecting ion strikes and correlating them with the time of arrival at the ion detector 147, the particular type of ion can be identified. The type of ions detected, as well as the number of each type of ion, can be indicative of the composition of the sample or characteristics of the sample. For example, the detected ions may correspond to substances that are inherently present in the native sample. Further, if desired the detected ions can include ions from labels added to the sample, such as for example elemental-tagged affinity markers as taught in U.S. Pat. No. 7,479,630, the contents of which are hereby incorporated by reference.

Generally, the analog signal generated by the ion detector 147 may require amplification by a signal amplifier 174 prior to its transmission for data processing. An ion detector of the type designed for electron multiplication (such as electron multipliers or photomultipliers for example) can typically generate sufficient voltage levels to endure transmission loss and for further handling. However, in certain cases, some electrical emission from various components in the system, or from external sources, can be significant enough relative to the instantaneous voltages of the analog signal to pose a potential interference. To address this, the generated analog signal can be amplified directly from the ion detector 147 to sufficient levels so that any contribution from electrical noise emission becomes negligible. Furthermore, to minimize any noise pickup, the location of the signal amplifier 174 can be positioned relatively near the ion detector 147 and/or electrical shielding can be implemented to shield the components carrying the signal to the signal amplifier.

Figure 2:
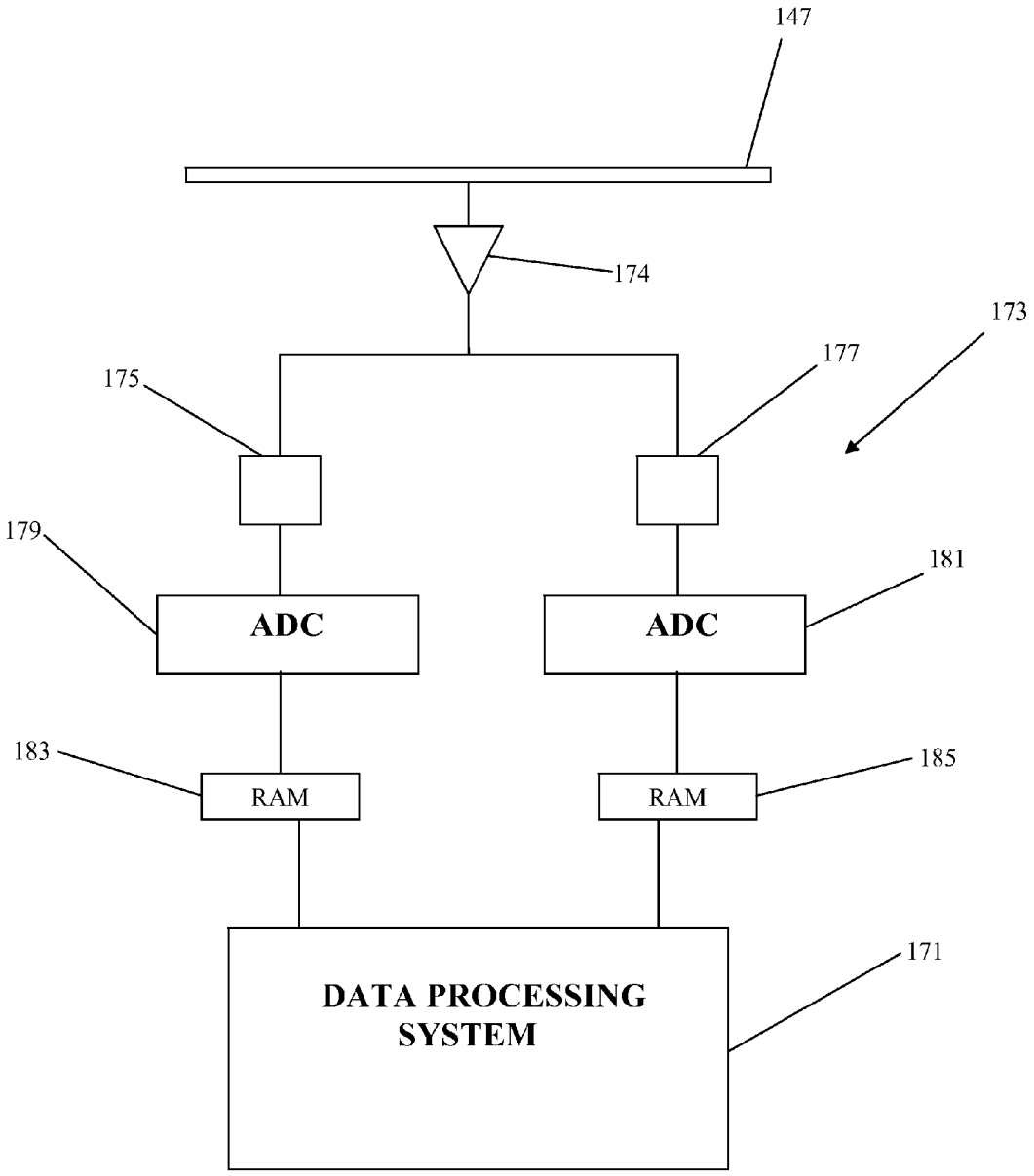
FIG. 2 is a schematic of an ion detector of the mass spectrometer connected to digitizing circuitry and a data processing system.

Referring now to FIG. 2, in order to create data easily manipulated by a data processing system 171 the analog signal from the ion detector 147 is converted to a digital signal by a digitizing system including data collection circuitry, generally indicated at 173. In the illustrated embodiment, the data collection circuitry includes a first amplifier/attenuator 175 and a second amplifier/attenuator 177 connected to the ion detector 147 through the signal amplifier 174. A first 8-bit analog to digital converter (ADC) 179 is connected to the first amplifier/attenuator 175 and a second 8-bit analog to digital converter (ADC) 181 is connected to the second amplifier/attenuator 177. The first and second ADCs 179, 181 can be identical, although non-identical ADCs may also be used. Each of the ADCs 179, 181 can be connected to corresponding data storage units, such as the random access memory (RAM) indicated by reference numbers 183 and 185. The RAMs are suitably connected to the data processing system 171. The selection of 8-bit ADCs 179, 181 was made for this embodiment because of the ready availability of 8-bit ADCs, but also because these ADCs have relatively high sampling rates of about 1 GHz. However, it will be understood that other types of ADCs can be used within the scope of the applicant's teaching.

The format of the data collection circuitry 173 can vary. For example, the first amplifier/attenuator 175 and its corresponding ADC 179 and RAM 183 can be integrated within a first waveform capture board while the second amplifier/attenuator 177 and its corresponding ADC 181 and RAM 185 can be integrated within a second waveform capture board. Alternatively, each amplifier/attenuator 175, 177, ADC 179, 181, and RAM 183, 185 can be configured as independent components or circuit boards, or all of the amplifier/attenuators, the ADCs, and the RAMs cab be combined into a single waveform capture board. The communication between the RAMs 183, 185 and the data processing system 171 can be facilitated through a conventional Peripheral Component Interconnect (PCI) interface. Typically, the PCI interface speed determines the maximum rate at which digital data can be transferred and, consequently, the transfer rate can set the maximum limit for the number of intervals that can be sampled, digitized and transferred for processing in a given time window. For example, a PCI-X bus rated at 64-bits and 33 MHz can generally transfer data at 264 MBps less overhead bits due to hardware/software requirements. With a pulsing system 149 operating at a typical frequency of about 76.8 KHz and ADC sampling rate of 1 GHz, a reasonable maximum number of intervals that can be transferred is about 3200 in order to be within the PCI-X's speed. Additionally, in the context of TOF mass spectrometry analysis, the maximum number of intervals that can be sampled during a time window is related to the mass range that can be measured. Thus, the mass range in a mass spectrum is limited by the PCI interface speed. In this example, the mass range in the spectrum is within a 3200 ns time window although a lower number of time intervals, and therefore mass range, can be selected for one or both time windows as required.

The amplifier/attenuators 175, 177 are set or selected so that the input voltage range to the ADCs 179, 181 is different. More particularly, one amplifier/attenuator 175 is set so that it has a lower full scale voltage range output than the other 177. This allows the ADC 179 connected to the lower range amplifier/attenuator 175 to resolve low-intensity analog signals from the ion detector 147 because they will fall within its full scale voltage range, or dynamic range. For a given resolution, the ADC 179 will have a lesser (or no) ability to resolve higher instantaneous voltage beyond its dynamic range. The other amplifier/attenuator 177 is set with a higher full scale voltage range output so that the ADC 181 will resolve higher instantaneous voltages because they fall within its dynamic range. For a given resolution, the higher range amplifier/attenuator 177 and ADC 181 has a lesser ability to resolve the lower instantaneous voltages beyond its dynamic range. For brevity, each of the ADCs 179, 181 and their corresponding amplifier/attenuators 175, 177 can be collectively referred to as the ADCs 179, 181 since their operation, in this instance, is generally codependent. The ADCs are configured to operate during overlapping, but non-coincident, time periods during the window of expected arrival time at the ion detector 147 of the ions from an individual mass spectrum, or at least the ions that are of interest from an individual mass spectrum.

The operation of the ADCs 179, 181 is now explained in the context of a TOF mass spectrometry application. The ADCs 179, 181 are operated in an overlapping fashion to extend the dynamic and mass range of the digitizing system 173. The first ADC 179 can be active during a first time window to digitize the signal from the ion detector 147 corresponding to a first portion of the mass spectrum. The second ADC 181 can be active during a second time window to digitize the signal from the ion detector corresponding to a second portion of mass spectrum. The first and second time windows are offset, but overlap during a target period to extend the dynamic range of the digitizer. Each time window represents a subset of the total mass range of the mass spectrum such that the lowest and highest range limits between the time windows define the total mass range. Since separate PCI interfaces can be used by each of the ADCs 179, 181 for communication to the data processing system 171, the data transfer rate limit of each ADC is independent. Thus the total mass range resulting from the offset and overlapping windows can be extended beyond the limits of a single ADC. Once the data processing system 171 receives the digitized data from both ADCs 179, 181, the data can be presented and stored as a summation over the total mass range or stored as independent data values for future computational processing. The window of overlapping operation of the two ADCs is suitably selected to coincide with expected arrival of the ions of most interest in the spectrum. This may vary, depending on the particular application.

For example, a typical mass spectrum in one embodiment of a mass cytometer instrument according to the teachings of U.S. Pat. No. 7,479,630 (e.g., the mass spectrometer 101) can be between 80 and 210 amu. Metal isotope tags used in the mass cytometer 101 can fall in a range of about 140-175 amu and more particularly within a range of about 159-169 amu. Ions of isotope tags of this mass will be expected to arrive at the ion detector 147 just past midway through the observational period. The lighter isotopes would be expected to arrive sooner and the heavier ones later than those in the range of 159-169 amu. The analog signal from the detector for the isotopes in the range of 159 to 169 amu can have a wide range of amplitudes corresponding to the wide variation in the numbers of isotopes that can be present in that range. In one embodiment the metal isotope tags are selected to be transitional elements, such as Lanthanides. The target period of overlap of the first and second ADCs 179, 181 can be set to correspond to the expected time of arrival of ions of the metal isotope tags. In one embodiment, the extent of the overlapping of the time windows of operation of the ADCs 179, 181 can be selectively varied to adjust the portion of the mass spectrum for which increased dynamic range will be provided.

Figure 3:
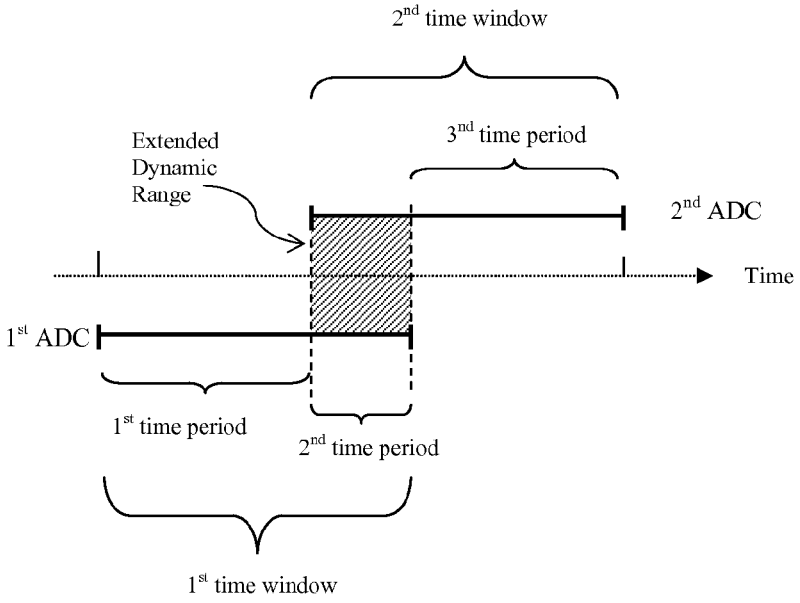
FIG. 3 is a graph illustrating operation of overlapping analog to digital converters of the digitizing circuitry.

FIG. 3 shows the operational sequence of the ADCs 179, 181. At the initiation of sampling, only the first ADC 179 is active to collect the analog signal from the ion detector 147. The first ADC 179 is sensitive within the low voltage range and provides digitized information as to the ions in a first portion of the mass spectrum that are observed in this first time period. During a second time period in which ions in a second portion of the mass spectrum of particular interest are expected to arrive at the ion detector 147, the second ADC 181 is activated so that both ADC's (179 and 181) operate during the second time period. The second time period may also be referred to as a "target period," and is shown as the cross-hatched segment in FIG. 3. In the target period, the effective dynamic range of the data collecting circuitry 173 is enhanced compared to the effective dynamic range outside the target period. While the number of sampling intervals during the time windows for each ADC 179, 181 are maximized according to the PCI interface speed, the ability to resolve adjacent masses (mass resolution) for each ADCs are therefore maintained. Very large amounts of data will be collected during the target period, but outside of the target period data will be collected at a lower rate. Because the target period is selected so the ions of greatest interest arrive during the target period, data collection is more efficiently focused on the ions of interest. During the target period when both ADCs 179, 181 are operating, the lower input range ADC 179 will be able to accurately digitize analog signals having a low instantaneous voltage and the higher input range ADC 181 will be able to accurately digitize analog signals having a high instantaneous voltage. After the target period, the first ADC 179 is de-activated, but the second ADC 181 continues to operate for a third time period in which it collects data about ion impacts from a third portion of the mass spectrum. Therefore, the digitizing circuitry has the ability to accurately convert analog signals having a large dynamic range during a target period and also to effectively increase the mass range over the entire period (e.g., first, second, and third time periods) during which data collection occurs. The increase in dynamic range is achieved without any reduction is the resolution of the first and second ADCs 179, 181.

The output of the digitizing circuitry is fed to the data processing system 171, which may comprise a computing device for manipulating the digitized signals to produce a useful output, such as the detection of certain isotope tags. Those skilled in the art will appreciate that aspects of the applicant's teaching may be practiced in network computing environments with many types of computer system configurations, including personal computers, hand-held devices, multi-processor systems, microprocessor-based or programmable consumer electronics, network PCs, minicomputers, mainframe computers, and the like. Aspects of the applicant's teaching may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

Although the data collection system 173 is illustrated above as part of a time-of-flight mass spectrometer system, it is understood the data collection system can be adapted for use in other types of time resolved systems, such as electrostatic or magnetic sector mass analyzers; imaging detection such as ultrasound or other systems using charged-coupled devices (CCD) image based sensors; light scattering devices using photomultiplier detectors; and communication systems or other high speed wave form capturing systems to name a few. Furthermore, the data collection system 173 can be provided separately from a mass spectrometer or any other system. For example, the data collection system 173 can be used to upgrade existing mass spectrometers and other systems.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A mass spectrometer comprising:

ion optics for receiving ionized sample material from an ion source and conveying at least some ions from the ionized sample material through the ion optics;

a time-of-flight mass analyzer coupled to the ion optics for receiving at least some of the ions conveyed by the ion optics, the mass analyzer comprising a time-of-flight chamber, an ion pulsing system for periodically generating an electrical field to direct groups of the received ions into the time-of-flight chamber, and an ion detector arranged to receive ions that have travelled through the time-of-flight chamber for generating a signal indicative of the number of ions arriving at the ion detector as a function of time, the signal including information about mass spectra of the groups of ions produced by the pulsing system;

a digitizing system for receiving and digitizing the signal from the ion detector and for providing extended dynamic range data during a target period, the digitizing system comprising; first and second analog-to-digital converters, the first analog-to-digital converter being configured to receive and digitize the signal from the ion detector during a first time window coinciding with a first portion of each mass spectrum, and characterized by a low full scale voltage range;

the second analog-to-digital converter being configured to receive and digitize the signal from the ion detector during a second time window coinciding with a second portion of each mass spectrum, and characterized by a high full scale voltage range;

wherein the first and second time windows are offset timewise relative to one another and overlap one another during the target period, and wherein the first and second time windows are selectively adjustable by a user to adjust the time window overlap during the target period.

2. A mass spectrometer as set forth in claim 1 wherein the first and second analog-to-digital converters are substantially identical.

3. A mass spectrometer as set forth in claim 2 wherein the first and second analog-to-digital converters are 8-bit converters.

4. A mass spectrometer as set forth in claim 1 wherein the digitizing system is adapted to apply a first voltage range to the signal from the ion detector before it is digitized by the first analog-to-digital converter and apply a second gain different from the first gain to the signal from the ion detector before it is digitized by the second analog-to-digital converter.

5. A mass spectrometer as set forth in claim 1 wherein the first and second analog-to-digital converters each have a sampling rate of at least 1 GHz.

6. A mass spectrometer as set forth in claim 1 wherein the first and second time windows have durations that are substantially equal to one another.

7. A mass spectrometer as set forth in claim 1 wherein the second time window is selectively variable.

8. A mass spectrometer as set forth in claim 1 wherein the ion source is adapted to atomize and ionize the sample material and the ion optics convey substantially only elemental ions to the time-of-flight mass analyzer.

9. A mass spectrometer as set forth in claim 1 wherein the first and second time windows each coincide with the expected times of arrival at the ion detector of ions having different ranges of masses, wherein each of said ranges is within a range of about 80 amu to about 210 amu.

10. A mass spectrometer as set forth in claim 1 wherein the target period coincides with the expected arrival time of at least some ions having masses in a range of about 140 amu to about 175 amu.

11. A mass spectrometer comprising:

ion optics for receiving ionized sample material from an ion source and conveying at least some of the ions from the ion source through the ion optics;

a time-of-flight mass analyzer coupled to the ion optics for receiving at least some of the ions conveyed by the ion optics, the mass analyzer comprising a time-of-flight chamber, an ion pulsing system for periodically generating an electrical field to direct groups of the received ions into the time-of-flight chamber, and an ion detector arranged to receive ions that have travelled through the time-of-flight chamber for generating a signal indicative of the number of ions arriving at the ion detector as a function of time, the signal including information about mass spectra of the groups of ions produced by the pulsing system;

a digitizing system adapted to receive and digitize the signal from the ion detector, the digitizing system being adapted to:

sample and digitize the signal in a first dynamic range during a first time period, sample and digitize the signal in a second dynamic range during a second time period, wherein the second dynamic range is greater than the first dynamic range, and then sample and digitize the signal in a third dynamic range during a third time period, wherein the third dynamic range is less than the second dynamic range, wherein each of the first, second, and third time periods corresponds to expected times of arrival at the ion detector of ions within a corresponding mass range; and wherein the first time period, second time period, and third time period are selectively adjustable by a user.

12. A mass spectrometer as set forth in claim 11 wherein the ion source is adapted to atomize and ionize the sample material and the ion optics convey substantially only elemental ions to the time-of-flight mass analyzer.

13. A mass spectrometer as set forth in claim 11 wherein the second time period is selectively variable.

14. A mass spectrometer as set forth in claim 12 wherein the first, second, and third time periods each coincide with the expected times of arrival at the ion detector of ions having different ranges of masses, wherein each of said ranges is within the range of about 80 amu to about 210 amu an wherein the second time period coincides with expected arrival of ions including at least some ions having masses in the range of about 140 amu to about 175 amu.

15. A method of operating a time-of-flight mass spectrometer, the method comprising:

conveying ionized sample material from an ion source to a time-of-flight mass analyzer comprising, a time-of-flight chamber, an ion detector, and an ion pulsing system;

periodically generating an electrical field using the ion pulsing system to direct a plurality of groups of the ions received by the mass analyzer through the time-of-flight chamber to the ion detector, outputting a signal from the ion detector indicative of the number of ions arriving at the ion detector as a function of time, the signal including information about mass spectra of the groups of ions produced by the pulsing system;

sampling and digitizing the signal from the ion detector in a first dynamic range during a first time period, sampling and digitizing the signal in a second dynamic range during a second time period, wherein the second dynamic range is greater than the first dynamic range, and then sampling and digitizing the signal in a third dynamic range during a third time period, wherein the third dynamic range is less than the second dynamic range, wherein each of the first, second, and third time periods corresponds to expected times of arrival at the ion detector of ions within each mass spectrum; and wherein the first time period, second time period, and third time period are selectively adjustable by a user.

16. A method as set forth in claim 15 further comprising atomizing the sample material, wherein the conveying comprises conveying substantially only elemental ions to the time-of-flight mass analyzer.

17. A method as set forth in claim 16 further comprising combining the sample material with elemental tags, wherein at least some of the elemental tags are selected from transitional elements and atomizing the sample comprises ionizing the elemental tags.

18. A method as set forth in claim 17 wherein the second time period coincides with the expected arrival time of at least some of the ionized elemental tags selected from the transitional elements.

19. A method as set forth in claim 15 wherein the second time period is selectively variable.

20. A method as set forth in claim 15 wherein the sampling and digitizing of the signal from the ion detector comprises using a first analog-to-digital converter to sample and digitize the signal during the first and second time periods and using a second analog-to-digital converter to sample and digitize the signal during the second and third time periods, the data produced by the first and second analog-to-digital converters during the second time period being combined to provide said extended dynamic range data during the second time period.

21. A digitizing system for receiving and digitizing an analog signal, the digitizing system comprising:

first and second analog-to-digital converters, the first analog-to-digital converter being configured to receive and digitize an analog signal from an ion detector during a first time window, the second analog-to-digital converter being configured to receive and digitize the analog signal from the ion detector during a second time window, wherein the first and second time windows are offset timewise relative to one another and overlap one another during a target period for providing extended dynamic range data during the target period; and wherein the first and second time windows are selectively adjustable by a user to adjust the time window overlap during the target period.

* * * * *